United States Patent [19]

Tabakov et al.

[11] 4,283,088

[45] Aug. 11, 1981

[54] THERMAL—MINING METHOD OF OIL PRODUCTION

[76] Inventors: Vladimir P. Tabakov, ulitsa Sofii Kovalevskoi, 4a, kv. 125; Boris P. Kornev, ulitsa Bulatnikovskaya, 1v, korpus 2, kv. 10; Leonid N. Buchenkov, ulitsa Geroev Panfilovtsev, 1, korpus 5, kv. 135; Andrei T. Gorbunov, ulitsa Nagornaya, 16, korpus 2, kv. 71, all of Moscow; Vladilen E. Kaschavtsev, ulitsa Sovetskaya, 64, kv. 41, Moskovskaya oblast, Noginsk; Viktor P. Pilatovsky, 1 Dmitrovsky proezd, 8, kv. 137, Moscow; Evgeny I. Gurov, ulitsa Mira, 2, kv. 3, Komi ASSR, Ukhta, poselok Yarega; Alexandr I. Obrezkov, ulitsa Neftyanikov, 1, kv. 14, Komi ASSR, Ukhta, poselok Yarega; Gadel G. Vakhitov, Leninsky prospekt, 67, kv. 188, Moscow; Rishad T. Bulgakov, ulitsa Beloglazova, 8, Tatarskaya ASSR, Almetievsk, Vladimir P. Maximov, 1 Dmitrousky proezd, 8, kv. 162, Moscow; Rafkhat A. Maxutov, Leninsky prospekt, 67, kv. 164, Moscow; Alexander I. Shnirelman, Uralskaya ulitsa, 6, korpus, 6, kv. 45, Moscow; Boris E. Dooroskak, ulitsa Voroshilova, 18, kv. 2, Talarskays ASSR, Bugukna; Khalim A. Asjandiyarov, ulitsa Tukaya, 73a, kv. 8, Tatarskaya, ASSR, Bugulma; Airat K. Falkullin, deceased, late of ulitsa Tukaya, 75a, kv. 10, Tatarskaya ASSR, Bugluma, by Neili N. Fatkullin, executrix; all of U.S.S.R.

[21] Appl. No.: 38,407

[22] Filed: May 14, 1979

[51] Int. Cl.[3] ..... E21C 41/10

[52] U.S. Cl. ..... 299/2; 166/272; 166/50

[58] Field of Search ..... 299/2; 166/268, 272, 166/263, 50

[56] References Cited

U.S. PATENT DOCUMENTS

| | | | |
|---|---|---|---|
| 1,722,679 | 7/1929 | Ranney | 299/2 |
| 1,842,098 | 1/1932 | Howard | 299/2 |
| 4,099,783 | 7/1978 | Verty et al. | 299/2 |
| 4,101,172 | 7/1978 | Rabbitts | 166/272 |

*Primary Examiner*—William F. Pate, III
*Attorney, Agent, or Firm*—Steinberg & Raskin

[57] ABSTRACT

A thermal-mining method of oil production is effected by digging a combination of underground workings and at least one working tunnel and by drilling injection and producing wells from said working tunnel. Then a heat carrier is forced into the oil-bearing bed for heating it to a temperature sufficient for the oil to acquire the necessary fluidity. The heat carrier is forced into the oil-bearing bed through injection wells at time intervals $t_1$ found from an appropriate relation. The oil is withdrawn from the oil-bearing bed through the producing wells at time intervals $t_3$ in which the time interval $t_1$ of heat carrier injection into the injection wells is divisible by the time interval $t_3$ of oil withdrawal from the producing wells, the multiplicity factor being equal to $n=(t_1/t_3)\geqq 60$.

31 Claims, 16 Drawing Figures

THERMAL—MINING METHOD OF OIL PRODUCTION

The present invention relates to the development of oil fields by a mining method and more particularly it relates to the method of thermal mining oil production.

The invention will be most effective in the development of oil fields with high-viscous crude and mobile bitumen.

The present invention can also be utilized for developing oil deposits with depleted reservoir energy.

At present such oil fields cannot, as a rule, be effectively developed by a conventional method wherein the oil is withdrawn from the wells drilled from the surface. Oil recovery attained in such cases is low.

Known in the prior art is a thermal-mining method of oil production wherein the oil-bearing bed is subjected to a steam and heat stimulation (cf. V.N. Mishakov et al "Experience gained in application of thermal methods for mining development of high viscous oil fields, magazine "Neftyanoe Khozyaistvo", No. 10, 1974, pp 31–35).

This method consists in digging a combination of underground workings above the oil-bearing bed, said combination including mine-shafts, shaft workings, drifts and drill chambers.

The slant and vertical injection and producing wells are drilled from the drill chambers located in the drifts. Then the heat carrier (steam) is supplied through the injection wells into the oil-bearing bed and said steam drives the oil from the injection to the producing wells. Then the oil is air-lifted from the producing well bottoms into the drill chambers.

A disadvantage of the above method is that in breakthroughs of steam into the underground workings occurs and, as a consequence, the efficiency of the thermal mining oil production method is reduced.

In another known method of mining oil production (U.S.A. Pat. No. 1,634,235) the wells are drilled from underground workings located either above or beneath the oil-bearing bed. The well bottom-hole zone is treated with steam and the oil is withdrawn therefrom through shallow wells bored downward or upward from the underground workings.

The well bottom-hole zones are heated by steam delivered into the well bottoms through pipes placed in the well and the oil is withdrawn from the same wells.

A disadvantage of this method consists in a low producing capacity of the oil-bearing bed.

Also known in the prior art is a well method of oil production (U.S.A. Pat. No. 1,520,737) which includes drilling a vertical shaft passing through an oil-bearing bed, and making a drill chamber beneath said shaft.

Then radial slant holes are drilled upward into the oil-bearing bed. In this method the heat carrier is pumped into the oil-bearing bed through the holes and the oil is withdrawn from the same holes after the oil-bearing bed has been sufficiently heated.

This method also provides for delivering a heat carrier (e.g. steam) through pipes passing through the holes in order to clean the well bore zone of oxidized oil and tarry matter and to withdraw the well product. The oil is withdrawn by gravity.

A disadvantage of this method of oil well production consists, as in the afore-mentioned method, in the absence of efficient driving of oil from the oil-bearing bed. This, in turn, results in low oil recovery.

A further method of oil field development known in the art is the so-called thermo-cyclic method (USSR Author's Certificate No. 335370, Cl.E21B 43/24) wherein the heat carrier is injected into the oil-bearing bed in a cyclic order, with the injecting in of cold water in between the cycles.

Alternation of heat carrier and cold water delivery causes to a reduction of heat losses into the surrounding rock and, as a consequence, to a reduction in the amount of required heat carrier. In the stratified-heterogeneous beds with various permeability of beds this alternation of heat carrier and cold water delivery eliminates the thermal influence of one bed on the others, thus increasing oil recovery from the oil-bearing bed as a whole.

A disadvantage of this method resides in the fact that its efficiency is substantially lower for the oil-bearing beds with a high and zonal heterogeneity and discontinuity than it is for the monolythic continuous beds. The wash-away properties of the water and condensate injected into the high-viscous oil-bearing beds are very low.

Also known in the prior art is a cyclic oil production method (U.S.A. Pat. No. 3,442,331, Cl. 166–263) in which the withdrawal of oil from an oil-bearing bed with a partly depleted producing energy is discontinued and the injection wells are filled with water. As soon as the reservoir pressure returns to the initial value, the injection of water through the injection wells is stopped and the oil starts to be withdrawn from the producing wells.

The oil is withdrawn until the bed pressure drops to a certain level after which the producing wells are laid off and water is again pumped into the oil-bearing bed through the injection wells.

The water pumping and oil withdrawal cycles are alternated until the oil resources in the bed are finally depleted.

A disadvantage of this method consists in its low efficiency during the development of oil-bearing beds with high-viscous oils since this method does not provide for reducing the viscosity of oil in the bed. Besides, this method provides for increasing the reservoir pressure to the initial level. When this method is realized for mining, restoration of the initial pressure is not always possible nor expedient, particularly in the oil fields consisting of fissured and cavernous-porous reservoirs.

A further prior art method of mining development of oil fields (USSR Author's Certificate No. 446,631) consists in digging a combination of underground workings and two working tunnels, drilling the injection wells from the upper working tunnel and the producing wells from the lower one. The heat carrier is delivered into the oil-bearing bed through the injection wells for heating said bed to a temperature at which the oil becomes sufficiently fluid. Then the heat carrier is delivered into the injection wells for uniform distribution of said carrier throughout the oil-bearing bed and for driving the oil into the producing wells, the oil is withdrawn from the producing wells to the working tunnel and thence through the underground workings, to the surface.

A disadvantage of this method consists in the necessity of constructing at least two working tunnels, i.e. considerable work is required to construct tunnels. The method is also characterized by heavy thermal losses caused by breaking of the heat carrier through the underground workings and bed fissures due to the absence of the adequate interrelation between the operating conditions of the injection and producing wells. These disadvantages result in a reduced current oil production and the final reservoir oil recovery.

The basic object of the invention resides in providing a method of thermal mining of high-viscous oil which increases the reservoir oil recovery bed as compared with the known similar methods of oil production.

Another no less important an object of the present invention resides in providing a thermal-mining method of thermal mines oil production which increases the effectiveness of heating the oil-bearing bed.

One more object of the present invention resides in providing a thermal-mining method of oil production which reduces the water content in the oil recovered from the oil-bearing beds with a high and zonal heterogeneity and intermittence of structure.

These and other objects are accomplished by providing a thermal-mining method of oil production consisting in:

digging a combination of underground workings and at least one working tunnel;

drilling injection and producing wells from said working tunnel;

injecting a heat carrier into the oil-bearing bed in order to heat it to a temperature at which the oil acquires the necessary fluidity;

injecting of a heat carrier into the oil-bearing bed through the injection wells for uniform distribution of the heat carrier through the entire oil-bearing bed and for driving the oil into the producing wells to the working tunnel at time intervals calculated from the relations:

$$t_1 = c\gamma\tau L^2/l$$

wherein c = heat capacity of the oil-bearing bed, J/deg;

l = temperature conductivity of the oil-bearing bed, $m^2/s$;

$\gamma$ = specific weight of the oil-bearing bed, $N/m^3$;

L = graphic, m; ($\tau$ = dimensionless time ($0<\tau\leqq 1$). ($0<\tau\leqq 1$).

withdrawing oil from the oil-bearing bed through producing wells at time intervals $t_3$ in which the time interval $t_1$ for delivering the heat carrier into the injection wells is divisible by the time interval $t_3$ for withdrawing oil from the producing wells, the multiplicity factor in being $$n = t_1/t_3 \geqq 60$$

wherein $$t_3 = \frac{A^2 \mu m(\rho_1 - \rho_2) B}{2 K \Delta P}$$

A = distance between injection and producing wells, m;

$\Delta p$ = pressure drop in the oil-bearing bed between injection and producing wells, $N/m^2$;

$\mu$ = oil viscosity, $N.s/m^2$;

m = porosity of the oil-bearing bed;

K = permeability of the oil-bearing bed, D;

$\rho_1 - \rho_2$ = change per cycle of oil-bearing bed saturation with heat carrier;

B = dimensionless parameter ($0<B<\infty$)

delivering the oil from said working tunnel through the underground workings to the surface.

The novelty of the disclosed method according to the invention consists in that the heat carrier is introduced into the oil-bearing bed in a cyclic manner with the heat carrier delivered into the injection wells at time intervals $t_1$ selected by the above relation and the oil withdrawn from the producing wells at time intervals $t_3$ determined by the above relation so that the relation of time intervals $t_1$ and $t_3$ is equal to or more than 60 ($n = t_1/t_3 \geqq 60$).

The oil recovery is increased by heating the oil-bearing bed and the oil saturating it and, consequently, most of all by reducing the oil viscosity and by changing the direction of the filtration flows in the oil-bearing bed.

The higher efficiency of heating the oil-bearing bed is achieved by better cycling of heat carrier introduction into the oil-bearing bed and withdrawal of oil therefrom through the producing wells.

The heating efficiency is increased also by a reduction of heat losses through the producing wells.

A reduction in the water content of the recovered oil is effected by the operational control of the producing and injection wells with due account taken of the zonal heterogeneity and discontinuity of the oil bed structure.

The recovery of high-viscous oil from the wells is increased by injecting steam into the wells for driving the well product into the working tunnel and blowing the well bottom with steam until the initial parameters of said steam are restored.

It is also expedient that the injection wells in the zonally heterogeneous oil-bearing bed should be divided into groups and the heat carrier should be injected into each group in an alternating sequence. This permits changing the direction of filtration flow in the oil-bearing bed which provides for increasing reservoir sweep and increases the oil recovery.

It is desirable that the producing wells in the zonally and lithologically heterogeneous oil-bearing beds should be divided into groups and the oil should be withdrawn alternately from each group. This makes it possible to create directional oil streams in the bed and to wash away the oil from the stagnant zones, thereby increasing the oil recovery of the bed.

It is practicable that the oil should be withdrawn from the producing wells in the heterogeneous fissured, fissured-porous and fissured cavernous-porous beds at such a rate that the time interval of heat carrier delivery into the injection wells would be divisible by the average time interval of oil withdrawal from the simultaneously working producing wells. In the course of development of an oil-bearing bed this will make it possible to take into account its structure and to increase oil recovery by changing the direction of filtration flow in the bed and prevent possible breakthroughs of steam into the producing wells. All these factors taken together increase the efficiency of the thermal-mining method of oil production.

It is desirable that the heat carrier should be delivered into the oil-bearing bed through pipes located in the wells, functioning as said injection wells and provided with two packers, near the well bottom and essentially in the middle of the wells, and the oil should be withdrawn through the perforated holes in the string of casing at the heat of the same wells, said perforated holes performing the function of said producing wells. This intensifies the heating of the oil-bearing bed, increases the drive conformance of said bed, steps up the oil recovery and the development rates.

It is desirable that in the oil-bearing beds with poorly-cemented collectors the annular space between the well walls and the pipes inserted into the wells should be filled between the packers with quick-hardening heat-carrier-impermeable compositions (e.g. cement mortar and the like). This will permit removing part of the string of casing between the packers, avoiding the breakthrough of steam into the working tunnel, thereby improving the efficiency of the thermal-mining method of oil production.

It is expedient that in driving the oil from heterogeneous, fissured-porous and fissured-cavernous-porous oil-bearing beds the heat carrier should be steam and, after said steam moving along the bed reaches the producing wells, the oil should be withdrawn together with steam through the producing wells up to the moment when the steam parameters (degree of dryness, specific volume and temperature) become equalized in the producing and injection wells i.e. when the initial parameters of steam are restored in the oil-bearing bed.

In this case the steam drives the oil first of all from the bigger cavities, pores and fissures of the oil-bearing bed into which said oil enters from the more solid sections, rock blocks due to condensation of steam in the porous medium of the oil-bearing bed.

Restoration of the initial parameters of steam in the oil-bearing bed after driving out the oil permits maintaining the temperature of the bed at a preset level and ensuring a higher productivity.

It is desirable that, concurrently with the supply of heat carrier into the injection wells and withdrawal of oil from the producing wells, one of the injection well groups should be continuously supplied with the solution of a material capable of reducing the surface tension on the oil-water and oil-rock boundaries. This will improve the wash-away properties of the driving medium and increase the oil recovery.

It is expedient that the oil should be withdrawn from the producing wells by forcing steam into the producing well bottoms for driving the oil therefrom to the working tunnel and then the producing wells should be blown until the steam restores its initial parameters and is then subjected to condensing.

The blowing raises the dryness of the steam and increases its specific volume. The blowing reduces strongly the specific volume of the working medium during steam condensation which ensures the influx of a considerable amount of oil to the well bottom within each cycle. This eventually steps up the well output and the total oil recovery of the oil-bearing bed.

The invention will now be described in detail by way of example with reference to the accompanying drawings, in which.

Figure 6:
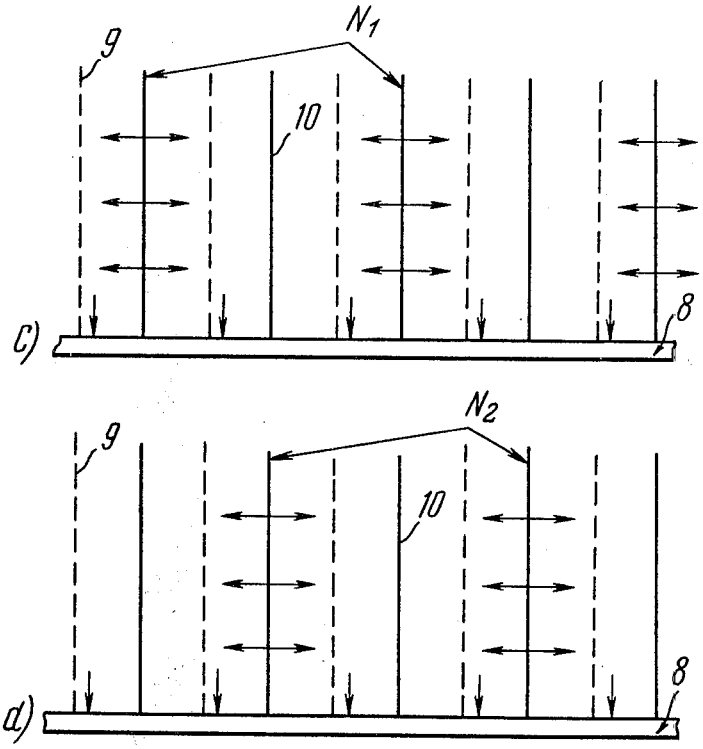
Figure 7:
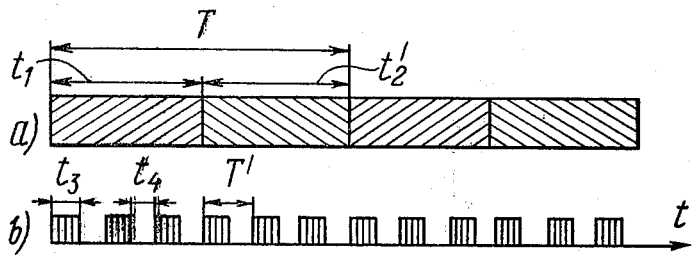
Figure 8:
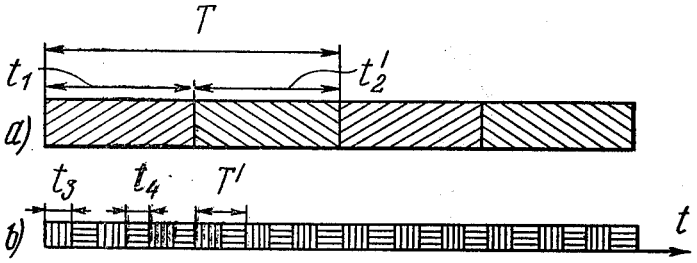
Figure 9:
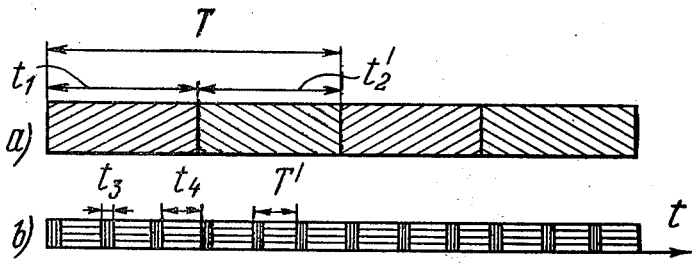
Figure 10:
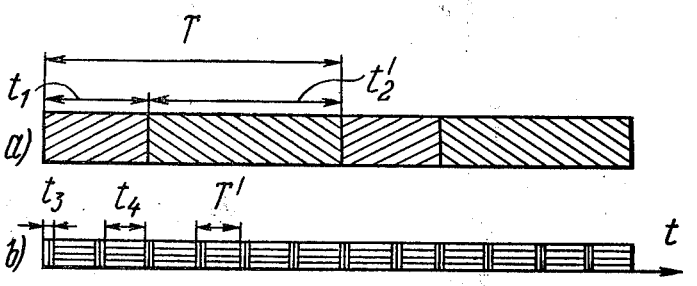
Figure 11:
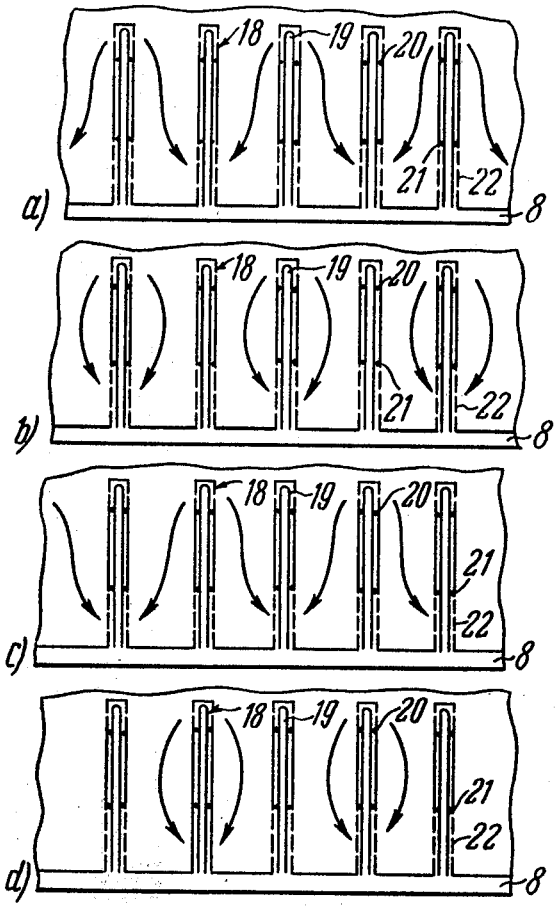
Figure 12:
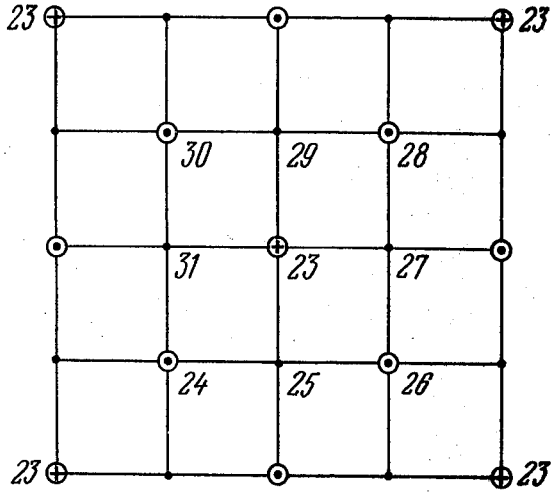
Figure 13:
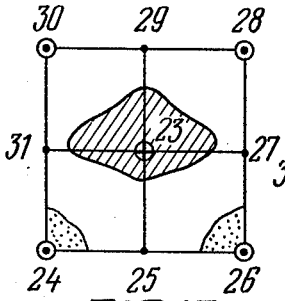
Figure 14:
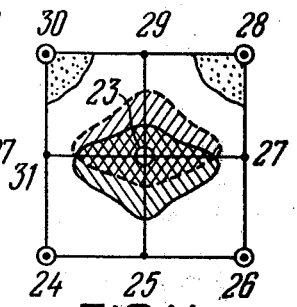
Figure 15:
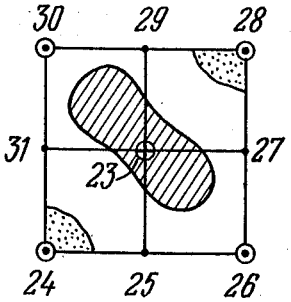
Figure 16:
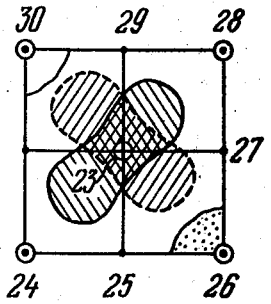

FIG. 5*a* characterizes the operation of injection wells;

FIG. 5*b* characterizes the operation of producing wells;

FIG. 6 illustrates a section of the oil-bearing bed with a system of drilled parallel injection and producing wells;

FIG. 6*c* illustrates operation of the first group of injection wells;

FIG. 6*d* illustrates operation of the second group of injection wells;

FIG. 7 is a conventional operating time diagram of injection and producing wells with the injection wells divided into two groups;

FIG. 8 is a conventional operating time diagram of the injection and producing wells with the injection and producing wells divided into groups;

FIG. 9 is a conventional operating time diagram of the injection and producing wells when the average oil withdrawal time from different groups of producing wells is different;

FIG. 10 is a conventional operating time diagram of the injection and producing wells when the time period of injection of heat carrier into the different groups of injection wells and the average time period of oil withdrawal from the different groups of producing wells are different;

FIG. 11 illustrates the operation of a group of wells when the heat carrier is injected in and the oil is withdrawn through the same wells;

FIG. 12 illustrates the layout of injection and producing wells;

FIG. 13 illustrates the operation of injection wells 23,24, 26 and producing wells 25,27,29,31;

FIG. 14 illustrates the operation of injection wells 23, 28,30 and producing wells 25,27,29,31;

FIG. 15 illustrates the operation of injection wells 23,24,28 and producing wells 25,27,29,31;

FIG. 16 illustrates the operation of injection wells 23,26,30 and producing wells 25,27,29,31.

The above-described method is carried into effect by digging a combination of underground workings comprising two drill holes, i.e. a lifting drill hole 1 (FIGS. 1,2), and a vent bore hole 2, a stockyard 3 (FIG. 2), near-well workings to accommodate an electric locomotive depot, a pumping plant, storehouses, etc. (not shown in the drawings), drifts 4 (FIGS. 1,2), slant workings 5 and 6. The drifts 4 are constructed above the roof of the oil-bearing bed 7. They are inclined to the horizontal in the order of 1°–3°.

Figure 1:
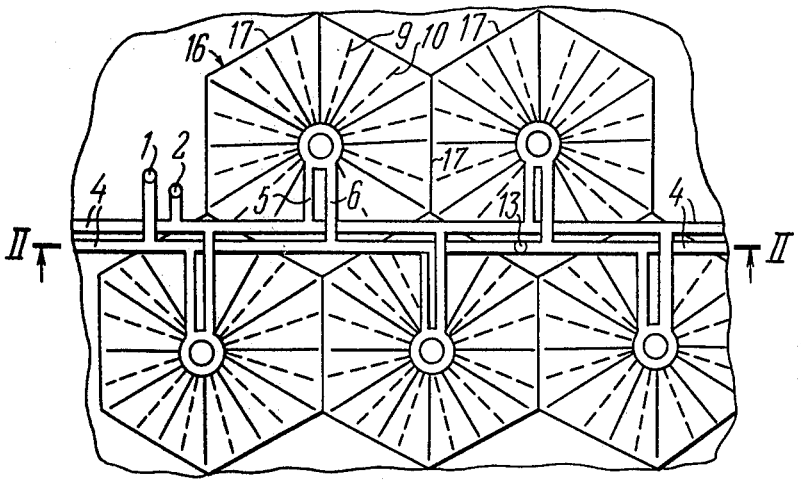
FIG. 1 is a plan view of a section of underground workings with horizontal and rising injection and producing wells arranged radially (the underground workings are shown in a single horizontal plane)
Figure 3:
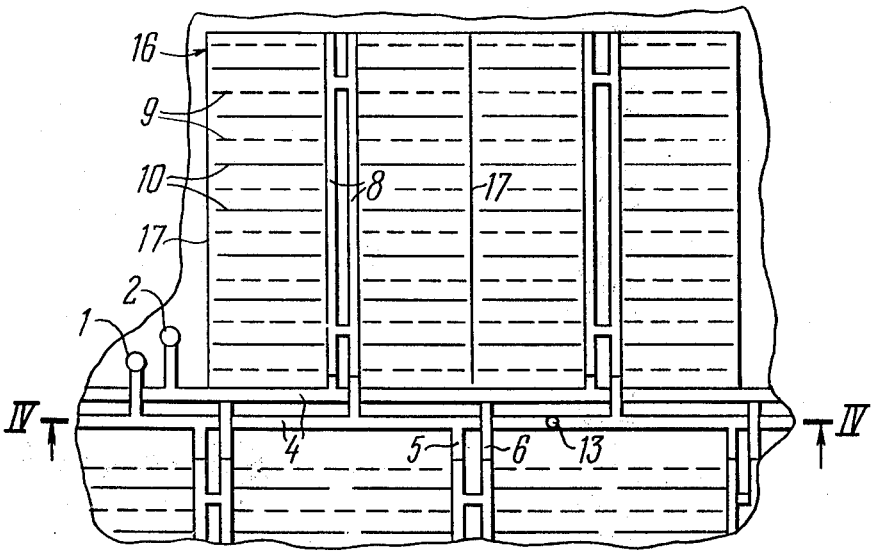
FIG. 3 is a plan view of a section of underground workings with rising injection and producing wells arranged parallel to one another (the underground workings are shown in a single horizontal plane)

The oil field is worked by sections. All the sections are identical with each other. They may be shaped as right polygons, e.g. hexagons as shown in FIG. 1 or rectangles as shown in FIG. 3 or any other shape.

Then slant holes 5 and 6 are dug from the drifts 4 (FIGS. 1, 2) into the zone of the oil-bearing bed 7 (FIG. 2) and at least one working tunnel 8 (FIGS. 1, 2) is constructed.

The working tunnel 8 may be either circular (FIG. 1), square rectangular, elliptical, rectilinear (FIG. 3), curvilinear or of some other shape to suit the shape of the oil field section.

Then from the working tunnel 8 (FIGS. 1, 2) are drilled producing wells 9 and injection wells 10. In case of a circular working tunnel 8 (FIG. 1) said wells are drilled uniformly around the section along the radiuses of the circle.

In the rectilinear working tunnel 8 (FIG. 3) the producing wells 9 and injection wells 10 are bored uniformly over the section area, parallel to each other.

The heat carrier (e.g. steam) is delivered to the heads of the injection wells from a boiler installation 11 (FIG. 2) through a surface pipeline 12, then through a steam delivery well 13 and the underground pipes accomodated in the drifts 4 (not shown in the drawings).

The oil-bearing bed 7 is heated through the system of injection wells 10 to a temperature at which the oil acquires the necessary fluidity.

For various oil fields this temperature may vary within considerable limits from about 80° to 250° and depends on the properties of the oil.

Thanks to a well-developed pattern of injection wells 10 extending through a long distance over the oil-bearing bed 7, the latter is uniformly and quickly heated throughout its volume. This is achieved because the horizontal and rising injection wells 10 extending through the oil-bearing bed 7 over tens and hundreds of meters interconnect its heterogeneous zones, various channels, cavities and increase the degree of development of the oil-bearing bed.

The presence in the oil-bearing bed 7 of fissures, mostly vertical, of highly permeable zones and cavities is conducive to rapid heating of said bed. With an increase in the temperature of the oil-bearing bed 7 the viscosity of oil decreases and its fluidity increases.

In the cases when the delivery of the heat carrier through the injection wells 10 alone results in a prolonged heating period of the bed, this process can be intensified by heating the oil-bearing bed 7 through both the injection wells 10 and the producing wells 9 by one of the conventional methods utilized in the practice of thermal-mining oil production.

The distance between the producing wells 9 and injection wells 10 is selected depending on the concrete geological conditions. They may be either identical or different.

The oil withdrawn from the producing wells 9 and delivered into the working tunnel 8 is directed into the grooves constructed in the drifts 4.

The oil together with the water delivered into the grooves is transported by gravity due to the inclination of the underground workings on the order of 1°–3° to the horizontal and flows to the installations (not shown in the drawings) where it is separated from the bulk of the water.

The oil with the associated water can also be transported from the working tunnel 8 through slanted workings 5 and 6, drifts 4 and pipes to said water-separating installations by means of pumps. From these installations the oil is pumped into the central underground oil collectors (not shown in the drawings) from where after primary preparation and heating it is delivered through pipes, special wells 14 or the mine-shaft into the surface reservoirs 15 of the oil storage depot.

The substance of the method does not change if the drifts 4 (FIG. 4) are built below the oil-bearing bed 7. Moreover, this arrangement of the drifts 4 provides better conditions for the delivery of oil from the working tunnels 8 into said drifts. In this case the oil is transported by gravity.

The working tunnel 8 may have the shape of two twinned underground workings as shown in FIG. 3 or of one circular working (FIG. 1), either rectilinear or curvilinear.

In all cases the length of the working tunnel 8 is selected, apart from all other conditions, on the basis of reliable venting. The ventilation system must guarantee adequate standards of labour protection and safety of the operating personnel.

After heating up the oil-bearing bed (FIG. 2), it is supplied through injection wells 10 with heat carrier at time intervals calculated from the relation:

$$t_1 = c\gamma\tau L^2/e$$

wherein c = heat capacity of the oil-bearing bed J/deg;

l = temperature conductivity of the oil-bearing bed, $m^2/s$;

$\gamma$ = specific weight of the oil-bearing bed, $N/m^3$;

L = graphic scale, m;

$\tau$ = dimensionless time ($O < \tau \leqq 1$); depending on the thickness of the oil bearing bed 7, temperature at the bottoms of the injection wells 10 and the number and arrangement of the injection wells 10. The value of $\tau$ is found from the equation comprising all the above-mentioned parameters. When the injection wells 10 are located in the roof and bottom portions of the bed, the equation for determining the dimensionless time is as follows:

$$X = Y_1F_1(h,\tau) + Y_2F_2(h,\tau)$$

wherein $$y_1 = \frac{\theta_1 - \theta_0}{\theta}; y_2 = \frac{\theta_2 - \theta_0}{\theta}$$

$\theta_1$ and $\theta_2$ = temperature on the bottoms of the injection wells in the roof and bottom portions of the bed, deg.C.

$\theta_o$ = initial temperature of the oil-bearing bed, deg.C.;

$\theta$ = temperature fall, deg. C.;

X = average temperature of the oil-bearing bed;

$\Theta$ = Jacobi theta function;

a = h/L h = thickness of the oil-bearing bed.

Oil is withdrawn from the producing wells 9 at such time intervals $t_3$ in which the time interval $t_1$ of delivering the heat carrier into the injection wells 10 is divisible by the time interval $t_3$ of withdrawing the oil from the producing wells 9, the multiplicity factor n being:

$$n = \left[\frac{t_1}{t_3}\right] \geqq 60$$

where $[t_1/t_3]$ stands for the operation of taking the whole part of the relation of two values $$t_3 = \frac{A^2\mu m(\rho_1 - \rho_2)\,B}{2\,K\,\Delta\,P}$$

where

A = distance between injection and producing wells, m;

$\Delta p$ = pressure drop in the oil-bearing bed between injection and producing wells, $N/m^2$;

$\mu$ = oil viscosity, $N.s/m^2$;

K = permeability of the oil-bearing bed; D;

m = porosity of the oil-bearing bed;

$\rho_1 - \rho_2$ = change per cycle of the oil-bearing bed saturation with heat carrier;

B = dimensionless parameter depending on the character of phase permeabilities of oil and heat carrier is determined from the relation:

$$B = \alpha H\left[F(\xi_0) - \alpha \int_{\xi_0}^{1} F_1(\xi)\, F^1(\xi)\, d_\xi\right] + \alpha,$$

$$\text{wherein } H = \frac{K_1}{\mu_1} / \frac{K_2}{\mu_2},$$

$k_1$, $k_2$ = permeability of the oil-bearing bed with respect to oil and heat carrier, D;

$\mu_1$, $\mu_2$ = viscosity of oil and heat carrier, N.s/m$^2$ $$\alpha = \frac{1}{F(\xi_0)}\,;\; F(\xi) = \frac{1}{H f_1(\xi) + f_2(\xi)}\,;$$

$$F_1(\xi) = H f_1(\xi)\, F(\xi);$$

$f_1(\xi)$ and $f_2(\xi)$ = phase permeabilities with respect to oil and heat carrier;

$\xi$ = saturation of the oil-bearing bed with heat carrier;

$\xi_o$ = saturation of the oil-bearing bed at the drive zone.

Selection of the divisible ratio of the time intervals of the heat carrier pumping cycle (e.g. steam) and the oil withdrawal cycle is necessary because the geometrical symmetry and orderliness of the oil field sections is supplemented in this case by the time symmetry in the sense of the multiplicity of the time intervals for pumping in the heat carrier and withdrawing the oil. Under the conditions of the divisibility of the time intervals for pumping in the heat carrier and withdrawing the oil the influences exerted on the filtration processes acquire a periodical or nearly periodical nature. Such influences on the processes of filtration are favourable for increasing the oil recovery.

The minimum multiplicity factor 60 between the time interval $t_1$ of delivering the heat carrier into the injection wells and the time interval $t_3$ of withdrawing oil from the producing wells is arrived at through thermohydrodynamic calculations of the heat balance of the oil-bearing bed in which, along with the heating of said bed, account has been taken of the heat losses through the roof and bottom of the oil-bearing bed and of the heat losses with the recovered oil within each oil withdrawal cycle from the bed through the producing wells.

Figure 5:
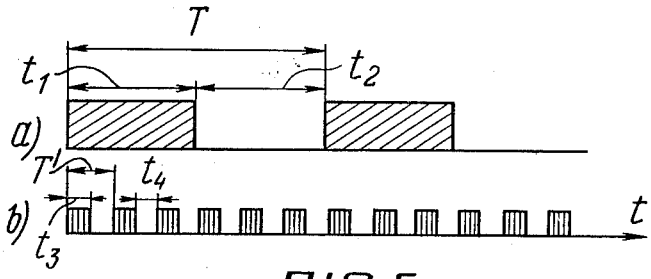
FIG. 5 is a conventional operating time diagram of injection and producing wells.

All the injection wells 10 of the worked sections 16 (FIGS. 1 and 3) separated from one another by arbitrary boundaries 17 are supplied within a certain time $t_1$ (FIG. 5) with a heat carrier after which the injection wells 10 (FIGS. 1,2) are closed and kept closed within a time interval $t_2$ (FIG. 5). In a particular case the time $t_1$ of delivery of the heat carrier (FIG. 5) through the injection wells 10 (FIGS. 1,2) may be equal to their idle time $t_2$. The entire working cycle T (FIG. 5) of the injection wells 10 (FIGS. 1,2) is equal to the sum of time intervals $t_1$ and $t_2$ (FIG. 5).

The oil is withdrawn through all producing wells 9 (FIGS. 1,2) both during the delivery of the heat carrier into the injection wells 10 and when they are laid off.

The time interval $t_3$ (FIG. 5) of oil withdrawal from the producing wells 9 (FIGS. 1,2) is alternated with their lay-off time $t_4$ (FIG. 5). In a particular case the time interval $t_3$ may be equal to the time interval $t_4$. The entire cycle of oil withdrawal T' from the producing wells is equal to the sum of time intervals $t_3$ and $t_4$.

The above-described process is shown in the operational time diagram of the injection and producing wells (FIG. 5).

Figure 2:
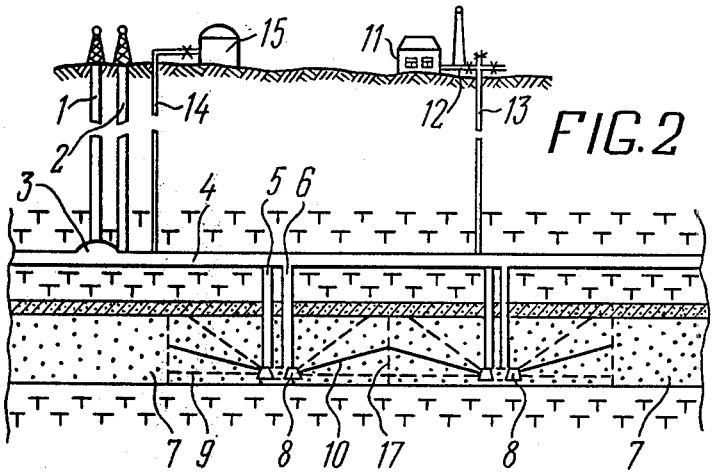
FIG. 2 is a section taken along line II—II in FIG. 1.

FIG. 5*a* illustrates the functioning of the injection wells 10 (FIGS. 1,2). The cross-hatched zone shows the time of heat carrier delivery through the injection wells 10.

FIG. 5 illustrates the functioning of the producing wells 9 (FIGS. 1,2). The vertical-hatched zone shows the time of oil withdrawal from the producing wells 9.

In the course of heat carrier delivery into the oil-bearing bed 7 (FIG. 2) and oil withdrawal from the producing wells the oil is hydrodynamically driven out of the oil-bearing bed 7. When the heat carrier is injected into the oil-bearing bed 7 and the withdrawal of oil from the producing wells 9 ceases, this leads to a rise of pressure and temperature in the oil-bearing bed.

Owing to this phenomenon the oil during the next withdrawal cycle is driven from the injection wells 10 to the producing wells 9.

While the injection and producing wells are laid off, there occurs capillary imbibition of the rock blocks in the fissured beds and of the low-permeability sections of the heterogeneous beds, this being accompanied by a redistribution of pressure.

When the oil is being withdrawn from the producing wells 9, the filtration flow change their direction thus increasing the oil recovery.

In another embodiment of the disclosed method all the injection wells in the zonally heterogenerous oil-bearing beds are divided into groups and alternately filled with the heat carrier depending on the technological conditions.

Shown schematically in FIG. 6 is a section of the oil-bearing bed 7 (FIG. 4) drilled out from the working tunnel 8 (FIG. 3) by a system of parallel injection wells 10 and producing wells 9. The injection wells 10 are divided into two groups with every other well in each group. FIGS. 6*c* and 6*d* illustrate the functioning of the first and second groups $N_1$ and $N_2$ of injection wells, respectively, in the same section.

FIG. 7 shows an operating time diagram of the injection and producing wells.

$t_1$ = time of delivery of heat carrier into the oil-bearing bed through the first group $N_1$ (FIG. 6) of injection wells (cross-hatched zone).

$t_2'$ = time of delivery of heat carrier into the oil-bearing bed through the second group $N_2$ of injection wells (zone cross-hatched in another direction).

The idle time of the first group $N_1$ of injection wells is $t_2'$ (FIG. 7) while that of the second group $N_2$ (FIG. 6) is $t_1$, which means that during the delivery of heat carrier through the first group $N_1$ of injection wells the second group $N_2$ of injection wells is laid off and vice versa, i.e. when the heat carrier is being injected into the second group, the first group stays idle.

The entire operating cycle of one group of injection wells $T = t_1 + t_2$.

$t_3$ = time of oil withdrawal from the producing wells 9 (FIG. 6) (vertical-hatched zone)

$t_4$ = idle time of producing wells 9.

The idle time of the producing wells 9 depends on the physical properties of the oil-bearing bed and of the oil saturating it. In some cases the time of oil withdrawal from the producing wells 9 may be equal to their lay-off time.

The entire operating cycle of the producing wells $T' = t_3 + t_4$ (FIG. 7*b*).

Figure 4:
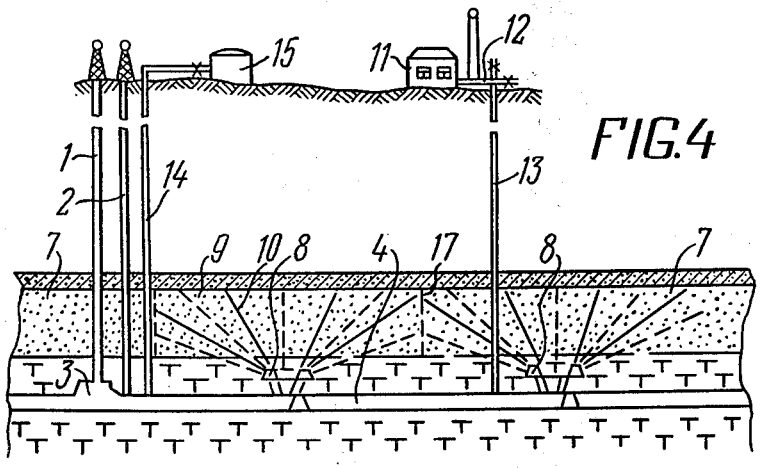
FIG. 4 is a section taken along line IV—IV in FIG. 3.

The cyclic pumping in of the heat carrier through different groups of injection wells 10 into the oil-bearing bed and the cyclic withdrawal of oil through all producing wells 9 results in a change of directions of the filtration flow in the bed, in washing-away of oil from the stagnant zones and bed sections with a low permeability which raises the productivity of the oil-bearing bed 7 (FIG. 4).

In another embodiment of the disclosed method the producing wells 9 (FIGS. 1 and 2) in the zonally and lithologically heterogeneous beds are also divided into groups and the oil is withdrawn from each group in an alternating order depending on the technological conditions.

Shown in FIG. 8 it is the time $t_1$ of injecting the heat carrier, into the first group of injection wells, the time $t_2'$ of injecting it into the second group of injection wells and the symbols $t_3$ and $t_4$ stand for the time of withdrawing the oil from the first and second groups of producing wells, respectively.

$t_3$ = the time of oil withdrawal from the first group of producing wells and is shown by vertical hatching.

$t_4$ = the time of oil withdrawal from the second group of producing wells and is shown by horizontal hatching.

The idle time of the first group of producing wells 9 (FIGS. 1,2) is $t_4$ while that for the second group is $t_3$ which means that while the oil is being withdrawn from the first group of producing wells the second group of producing wells stays idle and vice versa, while the oil is being withdrawn from the second group, the first group stays idle.

The cyclic injecting of steam into the various groups of injection wells 10 (FIGS. 1,2) with the cyclic withdrawal of oil permits raising the drive conformance of the oil-bearing beds with a high zonal and lithological heterogeneity thereby increasing the oil recovery.

In still another realization of the disclosed method the oil is withdrawn from the producing wells 9 (FIGS. 1,2) in the heterogeneous fissured, fissured-porous and fissured-cavernous-porous oil-bearing beds in such a manner that the time of injection of the heat carrier into the injection wells 10 is divisible by the average time of oil withdrawal from the concurrently working producing wells 9.

FIG. 9 shows an operating time diagram of two groups of injection wells and of two groups of producing wells, the time $t_3$ and $t_4$ being the average time of oil withdrawal from the different groups of producing wells.

Withdrawal of oil from the individual wells of each group is effected within different time intervals which depend basically on the breakthroughs of steam or water therein.

This permits creating filtration flow in the oil-bearing bed so that the oil-bearing bed 7 (FIG. 2) would be driven out to the fullest extent which would increase oil recovery and reduce the water content in the recovered oil.

With different time periods of oil withdrawal from the producing wells 9 it becomes possible to prevent steam breakthroughs into the underground workings through the producing wells 9 and thus to economize on the heat carrier.

FIG. 10 shows schematically a general example when the time intervals $t_1$ and $t_2$ required for injecting the heat carrier into different groups of injection wells are different and the average time periods $t_3$ and $t_4$ of oil withdrawal from the different groups of producing wells are also different.

The number of wells in the different groups of injection and producing wells may be either the same or different.

The durations of the cycles $t_1$ and $t_2$ of injection the heat carrier (e.g. steam) into the different groups of injection wells depend on the geological and physical characteristics of the oil-bearing bed and may range from 10 to 30 days and more. The injection pressure may dwell at a level of 20 kgf/cm$^2$.

The durations of the cycles $t_3$ and $t_4$ of withdrawing oil from the different groups of producing wells may vary from one to several hours.

In one practical realization of the disclosed method the heat carrier is injected into the oil-bearing bed through pipes 19 inserted into the wells 18 (FIG. 11) functioning as said injection wells; said pipes are provided with two packers, one (20) at the well bottom and the other one (21) essentially in the middle of the well 18 whereas the oil is withdrawn through the perforations in the string of casing 22, said perforations acting as said producing wells, near the heat of the same wells so that the time of heat carrier injection into said pipes would be divisible by the time of oil withdrawal through said perforations in the string of casing 22 at the head of the wells 18.

In the disclosed method the heat carrier is injected into the oil-bearing bed and the oil is withdrawn therefrom through the same wells either concurrently or separately, depending on the adopted technological procedure.

To prevent the heat carrier supplied into the oil-bearing bed from possible breaking through into the working tunnel 8, the wells 18 are provided with two packers one 20 installed near the bottom of the wells 18 and the other one 21, essentially in the middle of the well 18. The wells 18 are drilled from the working tunnel 8 FIGS. 1,2.

This version can be realized as described in any one of the versions described above.

In this case the operational time diagrams of the injection and producing wells given in FIGS. 5,7–9 hold true. The term "injection wells" in this case should be understood as the portions of the wells 18 (FIG. 11) extending from their bottom to the first packer 20 and the term "producing wells", as the portions of the wells 18 from their head to the second packer 21.

For example, let us consider an instance when the injection of heat carrier and withdrawal of oil are effected with the aid of parallel horizontal wells divided into groups, of say, every other well.

FIG. 11*a* shows the functioning of the first group of injection wells and of the second group of producing wells;

FIG. 11*b* shows the functioning of the first group of injection wells and of the first group of producing wells;

FIG. 11*c* shows the functioning of the second group of injection wells and of the second group of producing wells;

FIG. 11*d* shows the functioning of the second group of injection wells and of the first group of producing wells;

FIG. 11 shows by arrows the flows of the driving medium and driven-out oil.

As can be seen from the above figures, the realization of these versions of the method produce filtration flows with varying directions of oil flow. The injection of heat carrier into the pipes 19 allows the temperature of the well bottom zone to be maintained at a preset level thereby maintaining a high fluidity of oil.

All these factors taken together intensify the process of heating the oil-bearing bed, increase the drive conformance of the bed, increase the oil recovery and the development rates of the oil-bearing bed.

In another version of realization of the disclosed method when the oil-bearing bed is characterized by poorly cemented rocks, the annular distance between the walls of the wells 18 and the pipes 19 disposed therein between the packers 20 and 21 is filled with quick-hardening compositions impermeable to the heat carrier (e.g. cement mortar).

In this case there is no need to case off the well 18 by the string of casing throughout its length and to install two packers. It is enough to install one packer only, essentially in the middle of the well and to lower the string of casing 22 only to the point of packer installation. Efficient sealing of the annular space eliminates the breakthroughs of steam into the working tunnel 8. This, in turn, increases the thermal-mining method of oil production.

In another version of realization of the disclosed method in the heterogeneous fissured-porous and fissured-cavernous-porous oil-bearing beds 7 the oil is withdrawn after the heat carrier comes from the injection wells 10 to the producing wells 9 and the oil begins to be withdrawn together with the heat carrier through the producing wells up to the moment when the steam parameters (dryness, specific volume and temperature) become equalized in the producing wells 9 and in the injection wells 10.

The heat carrier (e.g. steam) injected into the oil-bearing bed 7 (FIG. 2) through the injection wells 10 creates certain flows in the oil-bearing bed 7. The characteristics of the pumped in steam (dryness, temperature and specific volume) are selected on the basis of the physical properties of oil and oil-bearing bed. The characteristics of the steam breaking through into the producing wells 9 differ from those of the steam injected into the injection wells 10. This is caused by the losses of heat through the roof and bottom of the oil-bearing bed 7 and with the produced liquid. When the producing wells 9 are closed at the moment of the breakthrough of the first portions of steam at the sections of the oil-bearing bed adjoining the producing wells 9, the characteristics of said steam are lower than those of the injected steam because the process of oil driving in the oil-bearing bed 7 is accompanied by an intensive heat exchange.

When the oil is withdrawn after the steam has broken through into the producing wells 9, the steam parameters (dryness, specific volume and temperature) increase to the values closely approaching those existing at the heads of the injection wells 10.

At the next stage, during condensation of steam in the oil-bearing bed 7, there occurs heat and mass exchange whose intensity rises with the increasing closeness of the steam parameters to the initial values. The oil-bearing bed 7 is heated more strongly, the oil flows from the less permeable sections into the larger pores and fissures due to capillary imbibition. When steam is condensed in large pores and fissures, the additional local pressure differentials ensure favourable conditions for the influx of oil from the smaller pores of the oil-bearing bed 7 and from its low-permeability sections.

During the next cycle of oil withdrawal from the producing wells 9 this oil flows into the working tunnel 8.

Equalization of said steam parameters in the producing and injection wells increases the efficiency of heating and the productivity of the oil-bearing bed 7.

In another embodiment of the disclosed method the injection wells are divided into groups and one of said groups is continuously supplied with a solution of the substance which reduces the surface tension at the oil-water and oil-rock boundaries, the uniformity of flow of this substance through the oil-bearing bed being controlled by the operation the producing wells. One of such substance is alkali, NaOH.

The filling of the oil-bearing bed with a water solution of alkali results in the formation of an emulsion of the "oil-in-water" type and in the transition from the hydrophobic to hydrophilic wettability of the rock. The emulsification of oil in a hydrophilic oil-bearing bed caused by the injection of alkaline solutions increases the fluidity of oil and decreases the fluidity of water.

The change of the nature of wettability of the rock and a great reduction of the surface tension in the "oil-water" system can be attained only through a definite relation of concentrations of alkali and salt in the solution.

The interaction of alkali with organic acids of the oil produces surface-active substances.

It is preferable that the aqueous solutions of alkali should be formed by the use of a water containing no multivalent ions (e.g. calcium). The presence of sodium chloride in water is conducive to a reduction of surface tension.

The concentration of the aqueous alkali solution for emulsification of oil should be 0.001–0.1 wt. % while for changing the nature of wettability of the bed rock it should be from 0.5 to 3.0 wt. %. The amount of alkali solution injected into the bed is, as a rule, 0.1–0.3 of the pore volume.

The reduction of the surface tension on the "oil-water" boundary from 25–30 dyne/cm to 0.01–0.001 dyne/cm permits the formation of finely-divided emulsions of the "oil-in-water" type which are capable of moving through solid low permeable rocks of the oil-bearing bed. This phenomenon is conducive to the injectivity of the injection wells.

Inasmuch as the aqueous alkali solution is injected into the already heated bed, the improvement of the wash away properties of the drive medium increases the oil recovery and raises the efficiency of the driving process.

The increased efficiency of the process of thermal-well oil production and of the oil-bearing bed productivity are also achieved because the molecules of the formed surface-active materials getting on the "rock-oil" boundaries which is conducive to the breakaway of the oil droplets from the surface of the rock while getting on the "oil-water" boundaries they form the above-mentioned finely-divided systems.

The improved wettability of the rock due to its hydrophilization under the influence of the aqueous alkali solution as well as emulsification of oil in the drive zone contribute to a stronger driving of oil from the bed as compared with water and steam, and to a better drive conformance which improves the most important factor of oil field development, i.e. productivity of oil-bearing bed.

The method includes the following operations:

1. The oil-bearing bed is heated by one of the conventional methods to a temperature at which the oil acquires the required fluidity.

2. The injection wells are divided into groups. At least one group of the injection wells is filled with a heat carrier (e.g. steam). The other group is filled with an alkali solution.

The number of injection wells for injection heat carrier into the oil-bearing bed should be sufficient for maintaining the above-stated temperature in the bed.

The number of injection wells for the injection of aqueous alkali solution into the oil-bearing bed should be sufficient for acting on the bed both horizontally and vertically, i.e. the well pattern must be uniform throughout the volume of said bed.

In the zone of the well used for acting on the bed with an alkali solution there must be several wells for injecting in steam.

3. The oil-bearing bed is constantly filled with an aqueous alkali solution through the wells selected for this operation, the amount of the alkali solution being 0.1–0.3 of the pore volume of the bed.

4. Other groups of the injection wells are filled with steam in accordance with one of the above-described versions.

5. The oil is withdrawn from the producing wells as described in one of the versions above so that the time of heat carrier injection into the injection wells would be divisible by the time of oil withdrawal from the producing wells.

Control of the injection of heat carrier into the oil-bearing bed through the injection wells and of the oil withdrawal through the producing wells permits changing the direction of the filtration flows of the aqueous alkali solution so as to ensure a maximum drive conformance of the bed.

Let us consider the functioning of the wells in the bed section when the injection and producing wells are drilled from the working tunnel 8 (FIG. 3).

Shown by black dots in FIG. 12 are the producing wells; a dot in a circle shows the wells for injecting in steam and a dot with a cross inside indicates the wells for injecting in an alkali solution.

The injection wells are divided into groups, the first being filled with an alkali solution and the second with steam.

The injection well 23 (FIG. 12) filled with the alkali solution functions continuously.

The injection wells 24,26,28,30 filled with steam function intermittently and their working order may be as follows.

First version. 1st half-cycle: wells 24 and 26 (FIG. 13) are operating and wells 28 and 30 are idle.

Meanwhile the zone of the alkali solution will be moving towards the wells 28, 29 and 30.

2nd half-cycle: wells 24 and 26 (FIG. 14) stay idle, wells 28 and 30 are in operation.

The zone of the alkali solution starts moving towards the wells 24,25 and 26.

Cross-hatched in different directions in FIGS. 13, 14 are the drive conformance zones with respect to the alkali solution during different half-cycles while dots show the zones with heat carrier.

Second version.

1st half-cycle-wells 24 and 28 (FIG. 15) are in operation, wells 26 and 30 stay idle.

The zone of oil driving by the alkali solution moves towards the wells 25,26,27 and 29,30,31.

2nd half-cycle-wells 26 and 30 (FIG. 16) are in operation, wells 24 and 28 are laid off.

The driving zone moves towards the wells 31, 24, 25 and 27,28,29.

As in FIGS. 13,14 the cross-hatching in different directions in FIGS. 15 and 16 shows the driving conformance zones under the effect of injected alkali solution in different half-cycles; dotted zones stand for the parts of the bed swept by the heat carrier.

The selection of the method of injection steam depends on the system of oil field facilities and on the geological structure of the oil-bearing beds.

The producing wells 25,27,29 and 31 (FIGS. 13–16) also operate cyclically in the above-stated order. This plays the role of an auxiliary element in the control of the process.

In another realization of the disclosed method the oil is withdrawn from the slant and vertical producing wells by injecting steam onto the bottoms of the producing wells through an annular space between the string of casing and the pipes designed to drive the oil through the pipes to the working tunnel after which the producing wells are blown through until the steam restores its initial parameters and is then condensed by cutting off its delivery.

The method is carried into effect by carrying out the following operations:

(1) The steam is injected in onto the bottoms of the producing wells through the annular space between the well walls or the string of casing and the string of pipes for driving the oil therefrom to the working tunnel.

(2) The production wells are blown with steam until the latter restores its initial parameters, i.e. the parameters exactly or nearly the same at which it was injected. The blowing increases the degree of dryness and the specific volume of steam.

(3) The production wells are closed thereby providing conditions for condensation of steam therein.

The process of blowing results in a radical reduction of the specific volume of steam during its condensation which ensures the influx of oil from the oil-bearing bed into the well. During the next steam injecting cycle the oil is injected from the well into the working tunnel.

Due to the additional pressure drops this increases the productivity of the oil-bearing bed not only in the slanting and vertical producing wells but also in the horizontal and rising producing wells.

When being regularly filled with steam, the wells are freed from the product entering thereto from the oil-bearing bed (oil, water and sand), the blown steam cleans the walls of the wells which facilitates the entrance of new portions of oil from the oil-bearing bed during the next condensation of steam.

The present invention can be utilized with no less success for producing fluid (free-flowing) bitumens.

We claim:

1. Method for thermal-mining for the production of oil, which comprises digging a combination of underground workings and at least one working tunnel;

drilling injection and producing wells from said working tunnel;

introducing a heat carrier into the oil-bearing bed until the same is heated to a temperature at which the oil acquires fluidity;

then further injecting a heat carrier into the oil-bearing bed through the injection wells at time intervals calculated by the following relation:

$t_1 = c\gamma\tau L^2/l$ wherein c = heat capacity of the oil-bearing bed J/deg,
l = temperature conductivity of the oil-bearing bed, $m^2/s$,
$\gamma$ = specific weight of the oil-bearing bed, $N/m^3$,
L = graphic scale, m,
$\tau$ = dimensionless time ($L < \tau \leqq 1$);
withdrawing the oil from the producing wells at time intervals $t_3$ in which the time interval $t_1$ for injecting the heat carrier into the injection wells is divisible by the time interval $t_3$ for withdrawing oil from the producing wells, the multiplicity factor n being:

$$n = \frac{t_1}{t_3} \geqq 60 \text{ where } t_3 = \frac{A^2\mu m(\rho_1 - \rho_2)B}{2K\Delta p}$$

A = distance between injection and producing wells m,
p = pressure drop in the oil-bearing bed between injection and producing wells, $N/m^2$,
$\mu$ = oil viscosity, $N.s/m^2$,
m = porosity of the oil-bearing bed,
K = permeability of the oil-bearing bed, D,
$p_1$-$p_2$ = change per cycle of the oil-bearing bed saturation with heat carrier,
B = dimensionless parameter ($O < B < \infty$);
and injecting the oil from said working tunnel through the underground workings up to the surface.

2. A method as claimed in claim 1 wherein the injection wells are divided into groups and the heat carrier is injected alternately into each group.

3. A method as claimed in claim 1 wherein the producing wells are divided into groups and the oil is withdrawn alternately from each group.

4. A method as claimed in claim 1 wherein the oil is withdrawn from the producing wells at times such that the time interval of heat carrier injection into the injection wells is divisible by the average time interval of withdrawing the oil from the concurrently running producing wells.

5. A method as claimed in claim 1 wherein the heat carrier is injected into the oil-bearing bed through pipes disposed in the wells, which function as said injection wells and which are provided with two packers, at the well bottom and essentially in the middle of the wells and wherein the oil is withdrawn through perforated holes functioning as said producing wells and located in the string of casing at the heads of the same wells.

6. A method as claimed in claim 5 wherein the annular space between the walls of the wells and the pipes located therein between the packers is filled with quick-hardening compositions impermeable to the heat carrier.

7. A method as claimed in claim 1 wherein the heat carrier is steam and wherein after said steam moving from the injection wells reaches the producing wells, the oil and steam are concurrently withdrawn through the producing wells up to the moment when the steam parameters of dryness, temperature and specific volume become equalized in the producing and injection wells.

8. A method as claimed in claim 2 wherein, concurrently with the injection of heat carrier into the injection wells and withdrawal of oil from the producing wells, one of the groups of the injection wells is continuously supplied with a solution of a material which reduces the surface tension on the oil-water and oil-rock boundaries.

9. A method as claimed in claim 8 wherein the wells supplied with surface-tension reducing materials are located in alternate rows and wherein in each row they are arranged in an alternating order.

10. A method as claimed in claim 1 wherein for withdrawing oil from the producing wells, steam is forced into the bottoms of the producing wells for driving oil therefrom to the working tunnel after which the producing wells are blown until the initial parameters of the steam is restored and then subjecting the same to condensation.

11. A method as claimed in claim 2 wherein the producing wells are divided into groups and the oil is withdrawn alternately from each group.

12. A method as claimed in claim 2 wherein the oil is withdrawn from the producing wells so that the time interval of heat carrier injection into the injection wells is divisible by the average time interval of oil withdrawal from the concurrently running producing wells.

13. A method as claimed in claim 2 wherein the heat carrier is injected into the oil-bearing bed through the pipes disposed in the wells, acting as said injection wells and provided with two packers, at the well bottom and essentially in the middle of the well and wherein the oil is withdrawn through perforated holes functioning in the recovery of said producing wells, said holes being located in the string of casing at the head of the same wells.

14. A method as claimed in claim 2 wherein the heat carrier is steam and, after said steam moving through the oil-bearing bed from the injection wells reaches the producing wells, the oil and steam are concurrently withdrawn through the producing wells up to the moment when the steam parameters of dryness, temperature and specific volume become equalized in the producing and injection wells.

15. A method as claimed in claim 2 wherein for withdrawing the oil from the producing wells the steam is injected into the bottoms of the producing wells for driving the oil therefrom to the working tunnel after which the producing wells are blown until the initial parameters of the steam is restored and then subjecting the same to condensation.

16. A method as claimed in claim 3 wherein the oil is withdrawn from the producing wells so that the time interval of heat carrier injection into the injection wells is divisible by the average time interval of oil withdrawal from the concurrently running producing wells.

17. A method as claimed in claim 3 wherein the heat carrier is injected into the oil-bearing bed through the pipes disposed in the wells, acting as said injection wells and provided with two packers, at the well bottom and essentially in the middle of the wells, and wherein the oil is withdrawn through the perforated holes acting as said producing wells and located in the string of casing at the head of the same wells.

18. A method as claimed in claim 3 wherein, the heat carrier is steam and, after said steam moving through the oil-bearing bed from the injection wells reaches the producing wells, the oil and steam are concurrentlyy withdrawn through the producing wells up to the moment when the steam parameters of dryness, temperature and specific volume become equalized in the producing and injection wells.

19. A method as claimed in claim 3 wherein, concurrently with the injection of heat carrier into the injection wells and withdrawal of oil from the producing wells, one of the groups of injection wells is continuously supplied with a solution of a material which reduces the surface tension on the oil-water and oil-rock boundaries.

20. A method as claimed in claim 3 wherein for withdrawing oil from the producing wells, steam is injected into the producing well bottoms for driving the oil therefrom to the working tunnel after which the producing wells are blown until the initial parameters of the steam is restored and then subjecting the same to condensation.

21. A method as claimed in claim 4 wherein the heat carrier is injected into the oil-bearing bed through the pipes disposed in the wells, acting as said injection wells, and provided with two packers, near the well bottom and essentially in the middle of said wells and wherein the oil is withdrawn through the perforated holes acting as said producing wells and located in the string of casing at the head of the same wells.

22. A method as claimed in claim 4 wherein the heat carrier is steam and after said steam moving through the oil-bearing bed from the injection wells reaches the producing wells, the oil and steam are concurrently withdrawn through the producing wells up to the moment when the steam parameters of dryness, temperature and specific volume become equalized in the producing and injection wells.

23. A method as claimed in claim 4 wherein, concurrently with the injection of heat carrier into the injection wells and withdrawal of oil from the producing wells, one of the groups of injection wells is continuously supplied with a solution of a material which reduces the surface tension on the oil-water and oil-rock boundaries.

24. A method as claimed in claim 4 wherein for withdrawing oil from the producing wells the steam is injected into the bottoms of said producing wells for driving the oil therefrom to the working tunnel after which the producing wells are blown until the initial parameters of the steam is restored and then subjected the same to condensation.

25. A method as claimed in claim 5 wherein the heat carrier is steam and, after said steam moving through the oil-bearing bed from the injection wells reaches the producing wells, the oil and steam are concurrently withdrawn through the producing wells up to the moment when the steam parameters of dryness, temperature and specific volume are equalized in the producing and injection wells.

26. A method as claimed in claim 5 wherein, concurrently with the injection of heat carrier into the injection wells and withdrawal of oil from the producing wells, one of the groups of injection wells is continuously supplied with a solution of a material which reduces the surface tension on the oil-water and oil-rock boundaries.

27. A method as claimed in claim 6 wherein the heat carrier is steam and, after said steam moving through the oil-bearing bed from the injection wells reaches the producing wells, the oil and steam are concurrently withdrawn through the producing wells up to the moment when the steam parameters of dryness, temperature and specific volume are equalized in the producing and injection wells.

28. A method as claimed in claim 6 wherein, concurrently with the injection of heat carrier into the injection wells and withdrawal of oil from the producing wells, one of the groups of injection wells is continuously supplied with a solution of a material which reduces the surface tension on the oil-water and oil-rock boundaries.

29. A method as claimed in claim 7 wherein, concurrently with the injection of heat carrier into the injection wells and withdrawal of oil from the producing wells, one of the groups of injection wells is continuously supplied with a solution of a material which reduces the surface tension on the oil-water and oil-rock boundaries.

30. A method as claimed in claim 7 wherein for withdrawing oil from the producing wells, the steam is injected into the bottoms of said producing wells for driving the oil therefrom to the working tunnel after which the producing wells are blown until the initial parameters of the steam is restored and then subjecting the same to condensation.

31. A method as claimed in claim 8 wherein for withdrawing oil from the producing wells, the steam is injected into the bottoms of said producing wells for driving the oil therefrom to the working tunnel after which the producing wells are blown until the initial parameters of the steam is restored and then subjecting the same to condensation.

* * * * *